US011626670B2

(12) United States Patent
Parsche

(10) Patent No.: US 11,626,670 B2
(45) Date of Patent: Apr. 11, 2023

(54) ELORAN RECEIVER WITH TUNED ANTENNA AND RELATED METHODS

(71) Applicant: Eagle Technology, LLC, Melbourne, FL (US)

(72) Inventor: Francis E. Parsche, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 269 days.

(21) Appl. No.: 16/990,151

(22) Filed: Aug. 11, 2020

(65) Prior Publication Data

US 2022/0050161 A1 Feb. 17, 2022

(51) Int. Cl.
*H01Q 7/08* (2006.01)
*H01Q 23/00* (2006.01)

(52) U.S. Cl.
CPC ..... *H01Q 23/00* (2013.01); *H01Q 7/08* (2013.01)

(58) Field of Classification Search
CPC ..... H01Q 23/00; H01Q 7/08; H01Q 7/06
See application file for complete search history.

(56) References Cited

U.S. PATENT DOCUMENTS

| | | | | |
|---|---|---|---|---|
| 5,818,385 | A | 10/1998 | Bartholomew | |
| 6,539,306 | B2 | 3/2003 | Turnbull | |
| 9,234,955 | B2 | 1/2016 | Leighton | |
| 9,948,452 | B1 | 4/2018 | Pearson et al. | |
| 2002/0003503 | A1* | 1/2002 | Justice | H01Q 7/08 343/788 |
| 2009/0256758 | A1* | 10/2009 | Schlub | H01Q 5/40 343/702 |
| 2017/0160370 | A1 | 6/2017 | Yakubisin et al. | |
| 2019/0356054 | A1 | 11/2019 | Parsche et al. | |
| 2019/0391223 | A1 | 12/2019 | Parsche et al. | |

OTHER PUBLICATIONS

Bartone et al., "H-field Antenna Considerations for eLoran Aviation Applications", IEEE, Proceedings of IEEE/ION Plans, The Institute of Navigation, May 2008, pp. 810-823.
U.S. Appl. No. 16/419,568; filed May 22, 2019 Francis E. Parsche.

* cited by examiner

*Primary Examiner* — Dieu Hien T Duong
(74) *Attorney, Agent, or Firm* — Allen, Dyer, Doppelt + Gilchrist, P.A. Attorneys at Law

(57) ABSTRACT

An eLORAN receiver may include an antenna and eLORAN receiver circuitry coupled to the antenna. The antenna may include a ferromagnetic core and an H-field signal winding coupled to the ferromagnetic core. The eLORAN receiver may have an antenna tuning device including a tuning winding surrounding the ferromagnetic core, and a tuning circuit coupled to the tuning winding.

25 Claims, 8 Drawing Sheets

ELORAN RECEIVER WITH TUNED ANTENNA AND RELATED METHODS

TECHNICAL FIELD

The present disclosure relates to the field of communication systems, and, more particularly, to radio frequency antennas and related methods.

BACKGROUND

For radio frequency (RF) communications in the very low frequency (VLF), low frequency (LF), and medium frequency (MF) ranges, for example, relatively large ground-based antenna towers are used for transmitting such signals. Such antenna configurations may include a tower several hundred feet in height connected to the ground at its base, with numerous guy wires connecting the tower to ground for stability.

Another example where large scale tower based antennas are used is low frequency transmission stations for navigation systems, such as the long range navigation (LORAN) system. LORAN was developed in the United States and Britain during World War II. Subsequent implementations provided for enhancements in accuracy and usefulness, including LORAN-C and the later enhanced LOng-RAnge Navigation (eLORAN) implementations. More particularly, eLORAN is a low frequency radio navigation system that operates in the frequency band allocation of 90 to 110 kHz. Low frequency eLORAN transmissions can propagate by ground wave, a type of surface wave that hugs the earth. Ionospheric reflections or sky waves are another significant mechanism of eLORAN wave propagation. With typical low frequency antennas, the tower itself is used as a monopole antenna. Because of the height of the tower, which may be 600 feet or more as a result of the operating wavelength, many upper wires connect to the tower top forming a resonating capacitor. These wires, known as top loading elements (TLEs), may approximate a solid cone. A common tower used in the United States was 625 feet tall, had 24 top loading elements, and a natural resonance near 110 kHz. A base loading inductor was used to force resonance at 100 kHz.

eLORAN may operate at low frequencies, such as 100 kHz, making the transmit antenna physical size large. Yet, in eLORAN, the antenna electrical size is small relative to the wavelength. Physics may limit the electrically small antenna fixed tuned bandwidth. One theory is the Chu Limit as described in the reference "Physical limitations of omnidirectional antennas", Chu, L. J. (December 1948), Journal of Applied Physics 19: 1163-1175, which is called out as a reference herein. The Chu Bandwidth Limit equation may $Q=1/kr^3$, where Q is a dimensionless number relating to bandwidth, k is the wave number$=2\pi/\lambda$, and r is the radius of a spherical analysis volume enclosing the antenna in meters. 3 dB antenna bandwidth in turn is equal to 200/Q. Antenna radiation bandwidth is a matter of considerable importance to eLORAN as it enables sharp eLORAN pulses with fast rise times to be transmitted and received. Sharper pules permit more transmitting stations and faster rise times better distinguish ground wave from skywave. Also, 60% rise times of say 50 microseconds or less are preferential for eLORAN pulses to discern the received ground wave from received sky wave.

While high radiation efficiency is needed in transmit antennas, high antenna efficiency is not required for eLORAN receive antennas. This is because naturally occurring "atmospheric noise" is abundant at the low frequencies used by eLORAN. As atmospheric noise is a matter of considerable importance in spectral allocation, it is cataloged by the International Telecommunications Union as the report "Radio Noise", Recommendation ITU-R P.372-8, FIG. 2 "Fa Versus Frequency". Curves B and A of this report indicate that at 100 kHz frequency atmospheric noise is 77 dB above the antenna thermal noise in quiet natural conditions free from manmade interference and that manmade noise is 140 dB above antenna thermal noise in high manmade noise conditions, i.e. there is significant "static" so to speak. Assuming a receiver noise figure (transistor thermal noise) contribution of about 10 dB, and knowing the directivity of an electrically small antenna cannot exceed 1.8 dB, the required receive antenna gain to resolve to natural noise in quiet conditions is $-77+10+1.8=-65$ dBi or decibels with respect or isotropic. At eLORAN frequencies, small inefficient antennas therefore suffice for reception.

Antennas to receive eLORAN transmissions are categorized as to E-field and H-field types. E-field antennas may be whips or patches, while H-field types may be loops, circles or windings. The E-field types are based on the divergence of electric current and are related to the dipoles and monopoles. The H-field types are based on the curl of electric current and therefore relate to loops and half loops. Both E-field and H-field antenna types respond to the far field radio waves providing useful reception. Further, both the E-field and H-field antenna types respond to both the E-fields and H-fields present in the far field radio wave.

There are many trades between the two receive antenna types. Important differences exist between the near field responses of the E-field and H-field antenna types. The E-field type has a strong radial E-field reactive near field response. Differently, the H-field type has a strong radial H-field reactive near field response. E-field antennas may pick up manmade electromagnetic interference (EMI) more than H-field antenna types. The accessories of man, such as high voltage powerlines, result in considerable charge separation and strong E-field EMI, to which the E-field type receive antenna will respond. The E-field antenna type is however useful for compactness and sensitivity and a whip of 24 inches length may be sensitive enough to receive to atmospheric noise levels. The H-field receive antenna may offer improved rejection of local EMI, rejection of P static or noise due to electric charge buildup, and direction of arrival information. Disadvantages of the H-field antenna may include increased cost as ferrite rods may be used.

With the rise of satellite based navigation systems, such as the Global Positioning System (GPS), there has been relatively little development or investment in terrestrial-based navigation systems, such as eLORAN, until recently. A renewed interest in such systems has arisen as a backup to satellite navigation systems, particularly since low frequency eLORAN signals are less susceptible to jamming or spoofing compared to the relatively higher frequency GPS signals. In free space, radio waves spread in both azimuth and elevation to attenuate with distance according to $1/r^2$, where r is the range in meters. So, free space waves become weaker by a factor of 4 with a doubling of distance. The ground wave propagation of eLORAN signals occurs with little to no elevation plane wave spreading, only the azimuthal spreading. So, the eLORAN ground wave may weaken with near 1/r attenuation rates. This fact, along with the high powers practical at terrestrial transmitting stations means received eLORAN signals can be very strong relative GPS signals.

SUMMARY

Generally, an eLORAN receiver includes an antenna, and eLORAN receiver circuitry coupled thereto. The antenna comprises a ferromagnetic core and an H-field signal winding coupled thereto. The eLORAN receiver also includes an antenna tuning device. The antenna tuning device comprises at least one tuning winding surrounding the ferromagnetic core, and a tuning circuit coupled to the at least one tuning winding.

In some embodiments, the at least one tuning winding comprises a plurality of tuning windings. The tuning circuit may comprise a resistor, and a capacitor coupled in series with the resistor. The antenna may comprise a pair of electrostatic patch elements on opposite sides of the ferromagnetic core.

More specifically, the ferromagnetic core may comprise a ferromagnetic medial portion and a plurality of ferromagnetic arms extending outwardly therefrom. The plurality of ferromagnetic arms may be arranged in aligned pairs. The plurality of ferromagnetic arms may define a cross-shape. The antenna may comprise a corrective winding surrounding the ferromagnetic core and configured to receive a calibration signal from the eLORAN receiver circuitry. For example, the ferromagnetic core may comprise at least one of ferrite, powdered iron, electrical steel, and nanocrystalline iron.

Another aspect is directed to an antenna to be coupled to eLORAN receiver circuitry. The antenna comprises a ferromagnetic core, an H-field signal winding coupled to the ferromagnetic core, and an antenna tuning device. The antenna tuning device comprises at least one tuning winding surrounding the ferromagnetic core, and a tuning circuit coupled to the at least one tuning winding.

Yet another aspect is directed to a method of making an antenna to be coupled to eLORAN receiver circuitry. The method comprises coupling an H-field signal winding to a ferromagnetic core. The method further comprises coupling an antenna tuning device to the ferromagnetic core. The antenna tuning device comprises at least one tuning winding surrounding the ferromagnetic core, and a tuning circuit coupled to the at least one tuning winding.

DETAILED DESCRIPTION

Figure 1:
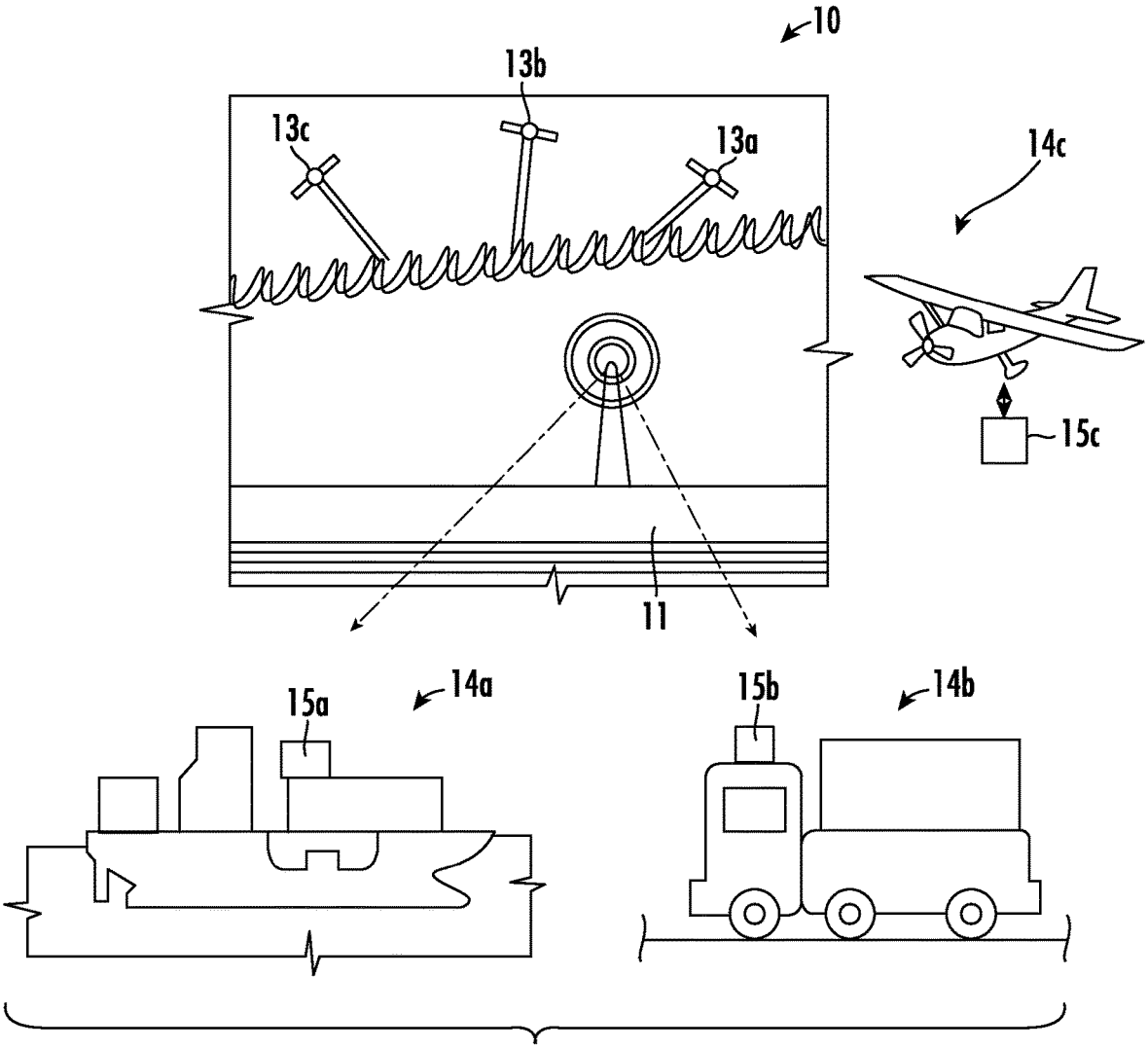
FIG. 1 is a schematic diagram of an eLORAN communication system, according to the present disclosure.

The present disclosure will now be described more fully hereinafter with reference to the accompanying drawings, in which several embodiments of the present disclosure are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

As such, further developments in eLORAN antenna systems may be desirable in certain applications. As noted above, given the operational frequency of eLORAN systems and the typical deployment in land vehicles and watercraft, the design of the eLORAN antenna may present unique design issues. In particular, given the mobile application of the eLORAN antenna, the antenna may desirably be small sized, durable, and with sufficient bandwidth. It is important that eLORAN receive antennas work in the complex environments of man to deliver accurate navigation and time.

Figure 2:
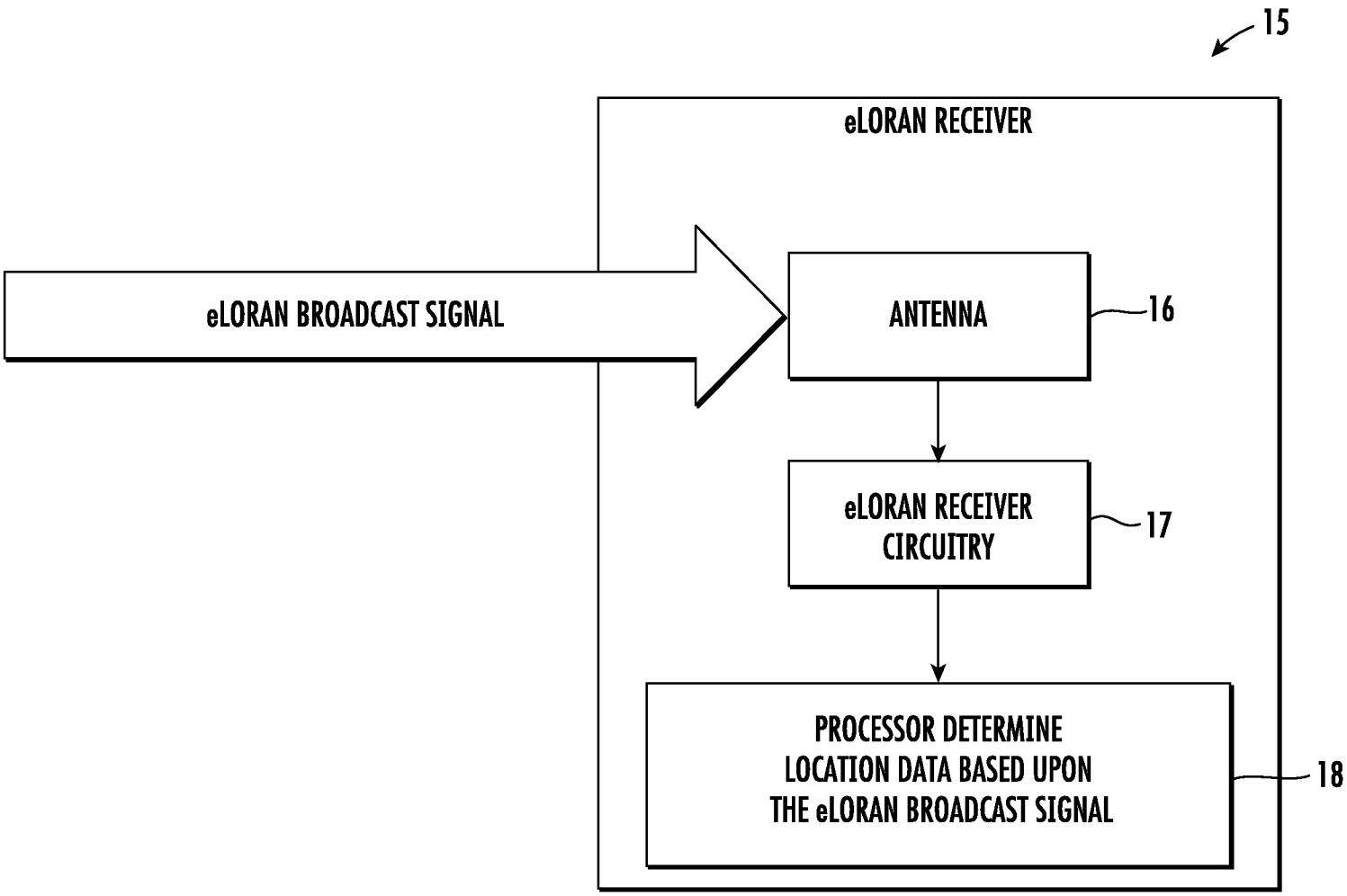
FIG. 2 is an eLORAN receiver from the eLORAN communication system of FIG. 1.

Referring initially to FIGS. 1-2, an eLORAN communication system 10, according to the present disclosure, is now described. The eLORAN communication system 10 illustratively includes an eLORAN broadcast station 11 configured to transmit an eLORAN broadcast signal.

Although not part of the eLORAN communication system 10, a plurality of GPS satellites 13*a*-13*c* is depicted. It should be appreciated that due to the low power and high frequency nature of GPS signals from the plurality of GPS satellites 13*a*-13*c*, the respective GPS signals are readily subject to natural and man-made interference (e.g. ionospheric, spoofing, jamming) and can be unusable in mountainous areas. Because of this, it is helpful to provide the eLORAN communication system 10 as detailed herein. Many systems will cooperatively use both GPS satnav and eLORAN groundnav information.

The eLORAN communication system 10 illustratively includes a plurality of vehicles 14*a*-14*c*. In the illustrated embodiment, the plurality of vehicles 14*a*-14*c* illustratively includes a watercraft 14*a*, a land based vehicle 14*b*, and an air based vehicle 14*c*. Each of the plurality of vehicles 14*a*-14*c* illustratively includes an eLORAN receiver 15*a*-15*c* configured to receive and process the eLORAN broadcast signal.

Each eLORAN receiver 15*a*-15*c* illustratively includes an antenna 16 and eLORAN receiver circuitry 17 coupled thereto. The eLORAN receiver 15*a*-15*c* illustratively includes a processor 18 coupled to the eLORAN receiver circuitry 17 and configured to determine position/location data based upon the eLORAN broadcast signal. As will be appreciated, the eLORAN receiver 15*a*-15*c* may include multiple internal receivers to receive and process the RF outputs of a plurality of receive antennas.

As will be appreciated by those skilled in the art, the antenna 16 is a dual H-field and E-field antenna system. The antenna 16 provides 3 antenna channels designated as the E channel, the Hx channel and the Hy channel. E-field antennas have a strong response to near electric fields, and H-field antennas have a strong response to near magnetic fields. Also, typical H-field antennas are closed electrical circuit loops, and E-field antennas are open circuit whips.

Due to the small size of eLORAN antennas deployed in the illustrated mobile applications, there is a design challenge to increase instantaneous gain bandwidth or receive bandwidth of these eLORAN antennas. Also, in typical mobile applications, there may be tuning drift due to changes in the eLORAN antenna environment, such as mounting the eLORAN antenna on a metallic or a nonmetallic surface. Proximity to a metallic surface may shade the radial magnetic near fields of H field type antennas, thereby reducing the antenna loop inductance in turn raising antenna resonant frequency. E-field type antennas may become monopoles rather than dipoles on metallic surfaces. The low frequencies used by eLORAN mean that all eLORAN antennas have rather far reaching reactive near fields.

Figure 3:
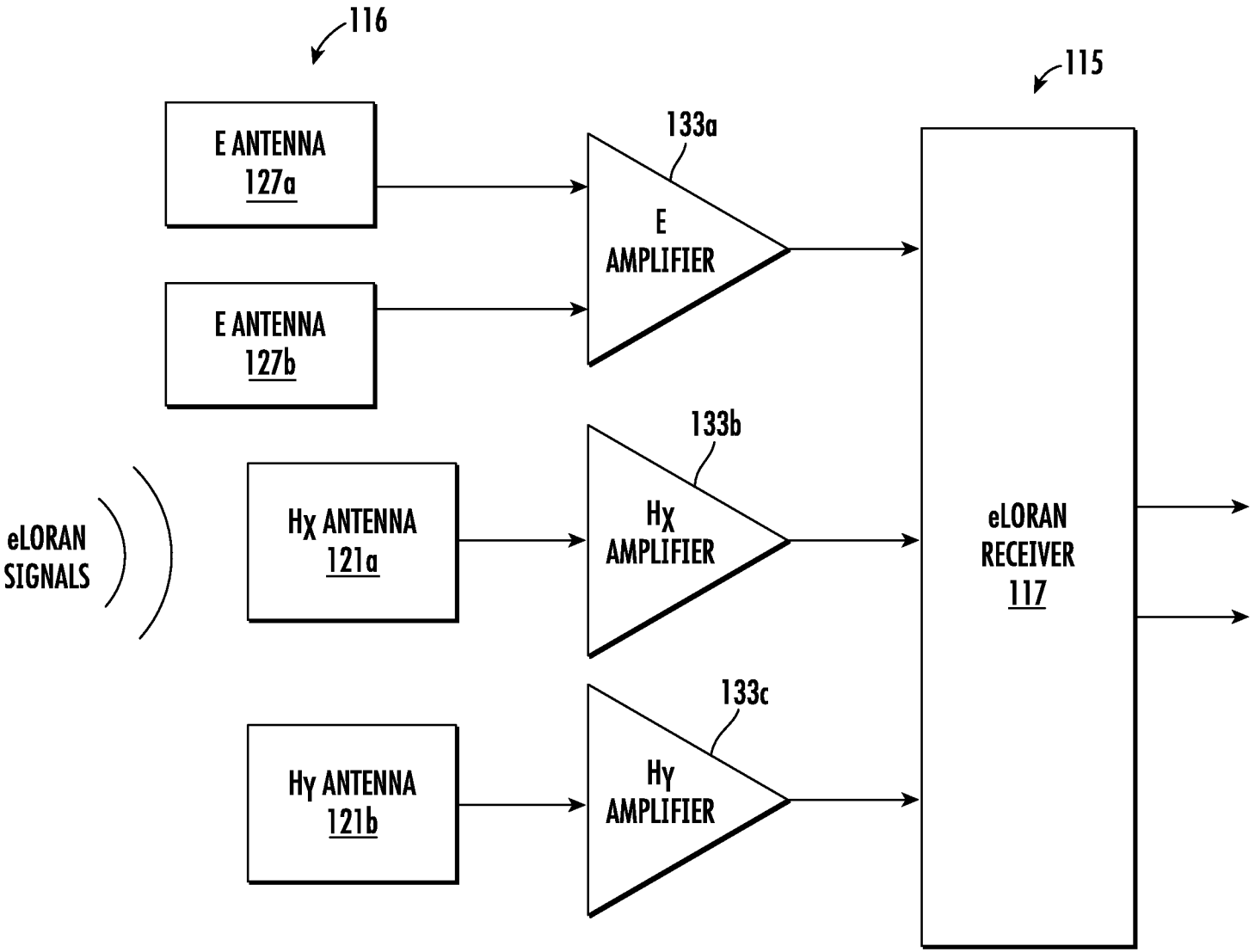
FIG. 3 is a schematic diagram of an eLORAN receiver, according to the present disclosure.
Figure 4:
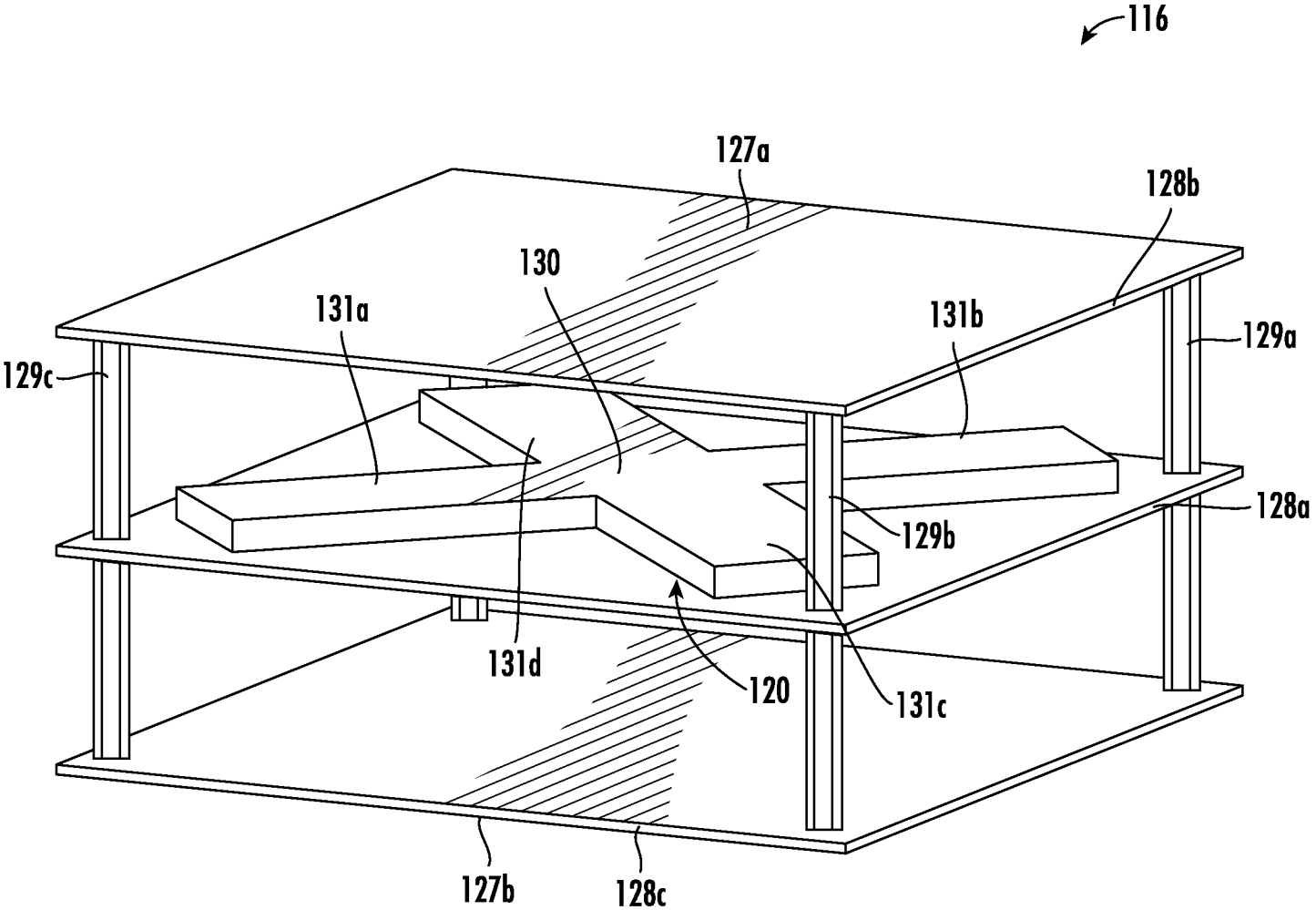
FIG. 4 is a schematic perspective view of an example embodiment of an antenna for the eLORAN receiver of FIG. 3 without the windings and circuitry.
Figure 5:
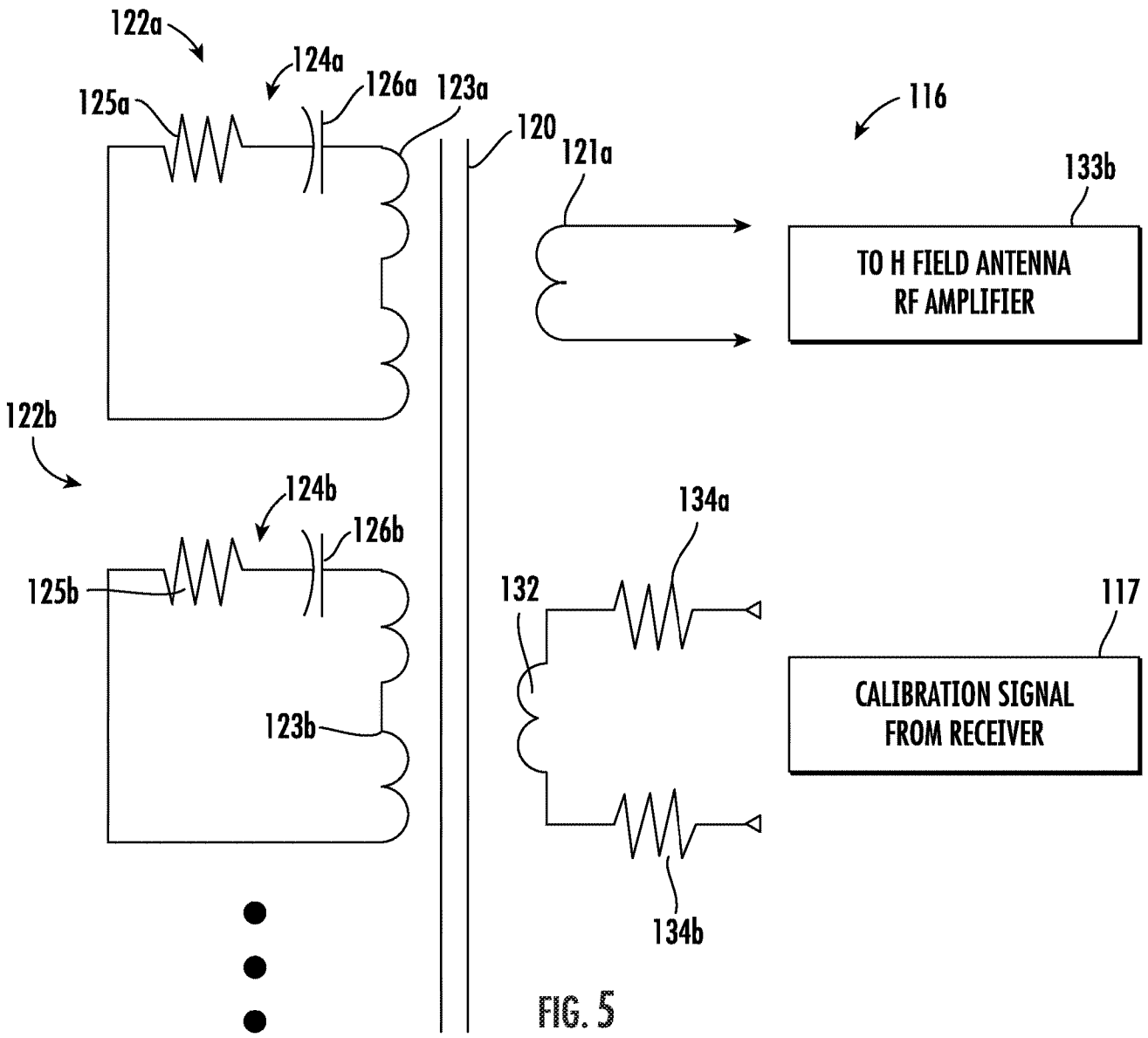
FIG. 5 is a schematic diagram of the tuning circuit and the antenna of FIG. 4.

Referring now to FIGS. 3-5, an eLORAN receiver 115 according to the present disclosure is now described. This eLORAN receiver 115 may provide an approach to the above issues, and also may be used in the eLORAN receiver 15*a*-15*c* of FIGS. 1-2. The three separate antenna channels E, Hx, and Hy may allow the receiver 115 to extract signals in interference, make angle of arrival determination, determine propagation delay from wave impedance, and to mitigate reradiation effects from nearby structures.

The eLORAN receiver 115 includes an antenna 116 and eLORAN receiver circuitry 117, coupled to the antenna by transmission line cabling, printed circuit traces or the like. The antenna 116 comprises a ferromagnetic core 120, and a plurality of H-field signal windings 121*a*-121*b* coupled to the ferromagnetic core. In some embodiments (FIG. 4), the ferromagnetic core 120 may comprise orthogonal ferromagnetic cores. In particular, the plurality of H-field signal windings 121*a*-121*b* is each wound around the ferromagnetic core 120, and illustratively generate $H_x$-field and $H_y$-field signals. For example, the ferromagnetic core 120 may comprise at least one of ferrite, powdered iron, electrical steel, and nanocrystalline iron.

The eLORAN receiver 115 also includes a plurality of antenna tuning devices 122*a*-122*b* coupled to the antenna 116. Each of the plurality of antenna tuning devices 122*a*-122*b* comprises a tuning winding 123*a*-123*b* surrounding (i.e. being wound around the core) the ferromagnetic core 120, and a tuning circuit 124*a*-124*b* respectively coupled to the tuning winding. Each tuning circuit 124*a*-124*b* comprises a resistor 125*a*-125*b*, and a capacitor 126*a*-126*b* coupled in series with the resistor. As will be appreciated, the resistor 125*a*-125*b* and the capacitor 126*a*-126*b* are resonant with a respective one of the plurality of tuning windings 123*a*-123*b* and broaden a bandwidth of the system. In some embodiments, the resistor 125*a*-125*b* and the capacitor 126*a*-126*b* respectively have adjustable resistance and capacitance to allow for tuning adjustments in real time.

The plurality of tuning winding 123*a*-123*b* may each have a number of turns greater than the turns in the plurality of H-field signal windings 121*a*-121*b*. For example, the plurality of H-field signal windings 121*a*-121*b* may have 9 turns, and the plurality of tuning winding 123*a*-123*b* may each have identical 80 turns.

For illustrative clarity, only two antenna tuning devices 122*a*-122*b* are shown, but it should be appreciated that some embodiments may include more than two antenna tuning devices. In other embodiments, only a single antenna tuning device may be used.

As perhaps best seen in FIG. 4, the antenna 116 comprises a pair of electrostatic patch elements 127*a*-127*b* on opposite sides of the ferromagnetic core 120 and configured to provide an E-field signal. In addition to the E-field signal function, the pair of electrostatic patch elements 127*a*-127*b* operate as electrostatic shields for the plurality of H-field signal windings 121*a*-121*b*. Additionally, the electrostatic patch elements 127*a*-127*b* shade the magnetic near fields of the Hx-antenna and the Hy-antenna to stabilize Hx-antenna and Hy-antenna tuning in different operating environments, and to reduce near field EMI coupling as might otherwise be caused by Hx, Hy antenna dipole moment. For instance, if the antenna 116 were to be placed on a metallic automobile roof, the metallic roof would not change the Hx-antenna, Hy-antenna tuning as the electrostatic patch elements 127*a*-127*b* provide a metallically preshaded, or "shielded" operating environment for the H-field signal windings 121*a*-121*b*. Without the electrostatic patch elements 127*a*-127*b*, the car roof would change the extent of the plurality of H-field signal windings 121*a*-121*b* inductance and tuning. The Hx-antenna and Hy-antenna are preadjusted to the presence of the plurality of electrostatic patch elements 127*a*-127*b*. The plurality of electrostatic patch elements 127*a*-127*b* does not comprise a closed electrical circuit to the Hx and Hy antennas and does not suppress signal reception by the Hx and Hy antennas.

In particular, the antenna 116 comprises a medial circuit board 128*a* carrying the ferromagnetic core 120, a first outer circuit board 128*b* carrying a respective electrostatic patch element 127*a* on an outer surface (i.e. the surface facing away from the medial circuit board), and a second outer circuit board 128*c* carrying a respective electrostatic patch element 127*b* on an outer surface (i.e. the surface facing away from the medial circuit board). Also, the antenna 116 comprises a plurality of vertical supports 129*a*-129*c* coupled between the medial circuit board 128*a* and the first and second outer circuit boards 128*b*-128*c*. Each of the plurality of vertical supports 129*a*-129*c* may comprise a dielectric material.

The medial circuit board 128*a*, and the first and second outer circuit boards 128*b*-128*c* are each planar circuit boards. Also, as illustrated, the medial circuit board 128*a*, and the first and second outer circuit boards 128*b*-128*c* are arranged in a stacked arrangement. The medial circuit board 128*a* comprises a dielectric base layer, and associated circuitry carried thereon. The first and second outer circuit boards 128*b*-128*c* each also comprises a dielectric base layer (e.g. fiberglass), and an electrically conductive patch layer (e.g. copper, aluminum) thereon.

Figure 6:
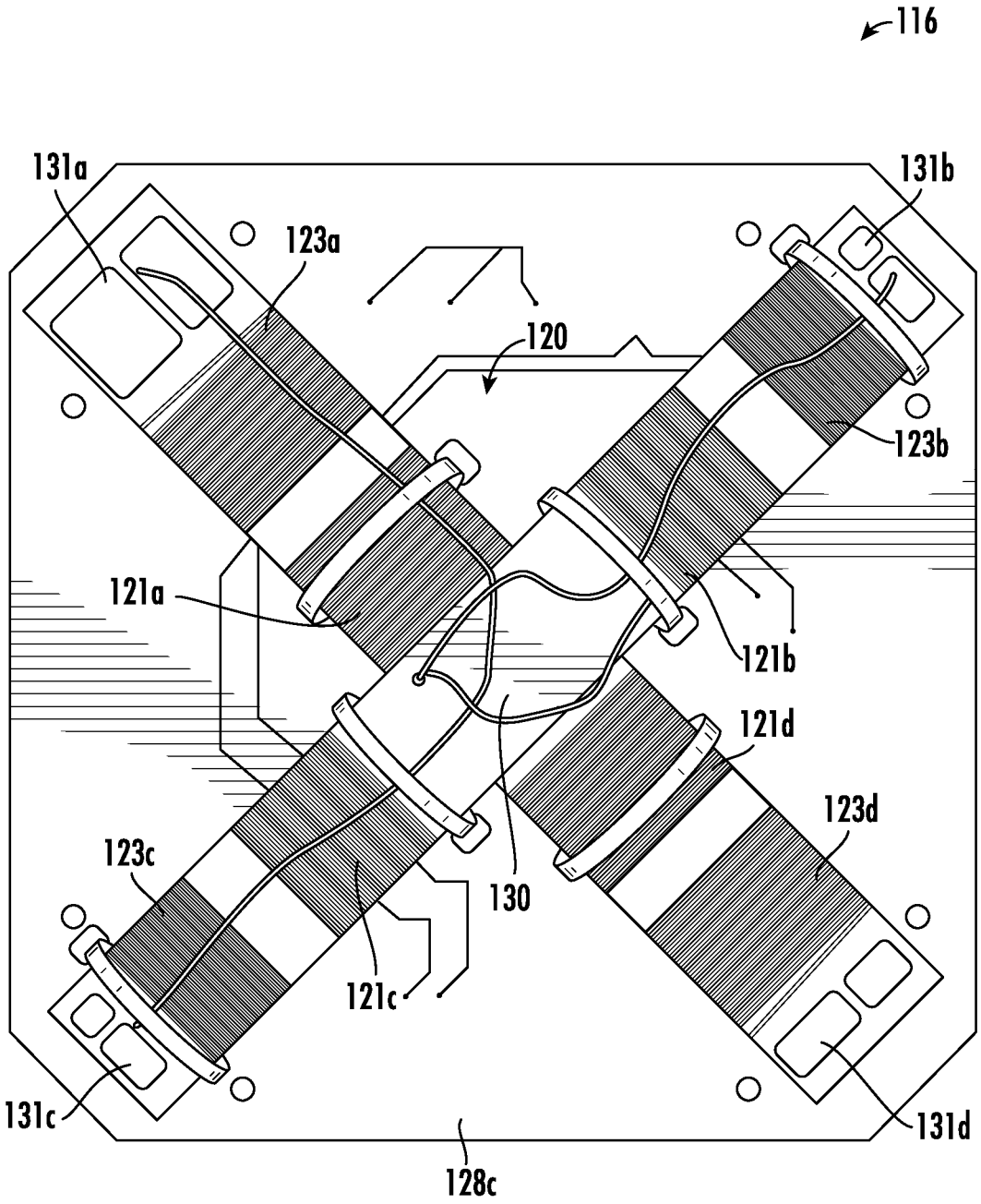
FIG. 6 is a top plan view of the example embodiment of the antenna of FIG. 4.

More specifically, as perhaps best seen in FIG. 6, the ferromagnetic core 120 comprises a ferromagnetic medial portion 130 and a plurality of ferromagnetic arms 131*a*-131*d* extending outwardly therefrom. The plurality of ferromagnetic arms 131*a*-131*d* is illustratively arranged in aligned pairs, and define a cross-shape or X-shape (i.e. non-orthogonal pairs). This avoids the closed magnetic circuit effect as would occur if the ferromagnetic arms were arranged in a square rather than the X-shape. In some embodiments, the ferromagnetic core 120 comprises an integral single piece, but in other embodiments, the ferromagnetic core may comprise ferromagnetic segments, as illustrated in FIG. 6. The illustrated embodiment may provide 360° azimuth coverage and angle of arrival information.

In some embodiments (not shown), the ferromagnetic core 120 may comprise a single rectangular bar in shape. In this embodiment, the pair of electrostatic patch elements 127*a*-127*b* may be replaced with thin sheets of electrically conductive material (e.g. copper, aluminum) wrapped around opposing distal ends of the rectangular bar.

The antenna 116 illustratively includes a corrective winding 132 surrounding the ferromagnetic core 120 and configured to receive a calibration signal from the eLORAN receiver circuitry 117. The antenna 116 illustratively includes first and second resistors 134*a*-134*b* coupled to the corrective winding 132 to adjust coupling level, which may be a "loose coupling" or low coupling level as the calibration injection signal may be sent up from the receiver at a high amplitude. The first and second resistors 134*a*-134*b* are level adjusting resistors (i.e. providing a desired voltage drop). The corrective winding 132 is configured to inject the calibration signal. The eLORAN receiver circuitry 117 is configured to generate the calibration signal comprising an amplitude and phase calibration signal based upon an output from the plurality of H-field signal windings 121*a*-121*b*. In particular, the calibration signal is generated from an applied sweep signal for the plurality of H-field signal windings 121*a*-121*b*.

The eLORAN receiver 115 illustratively includes a plurality of amplifiers 133*a*-133*c*. The plurality of amplifiers 133*a*-133*c* is coupled respectively between the pair of electrostatic patch elements 127*a*-127*b*, the H-field signal winding 121*a*-121*b*, and the eLORAN receiver circuitry 117. Also, although not shown in FIG. 4, the antenna 116 comprises a plurality of feed lines respectively coupled between the pair of electrostatic patch elements 127*a*-127*b* and the amplifier 133*a*. The antenna 116 also includes a plurality of feed lines respectively coupled between the plurality of tuning windings 123*a*-123*b* and the amplifiers 133*b*-133*c*. In some embodiments, the plurality of amplifiers 133*a*-133*c* is carried by the medial circuit board 128*a*, which provides for a compact package that is helpful in mobile applications.

Figure 7:
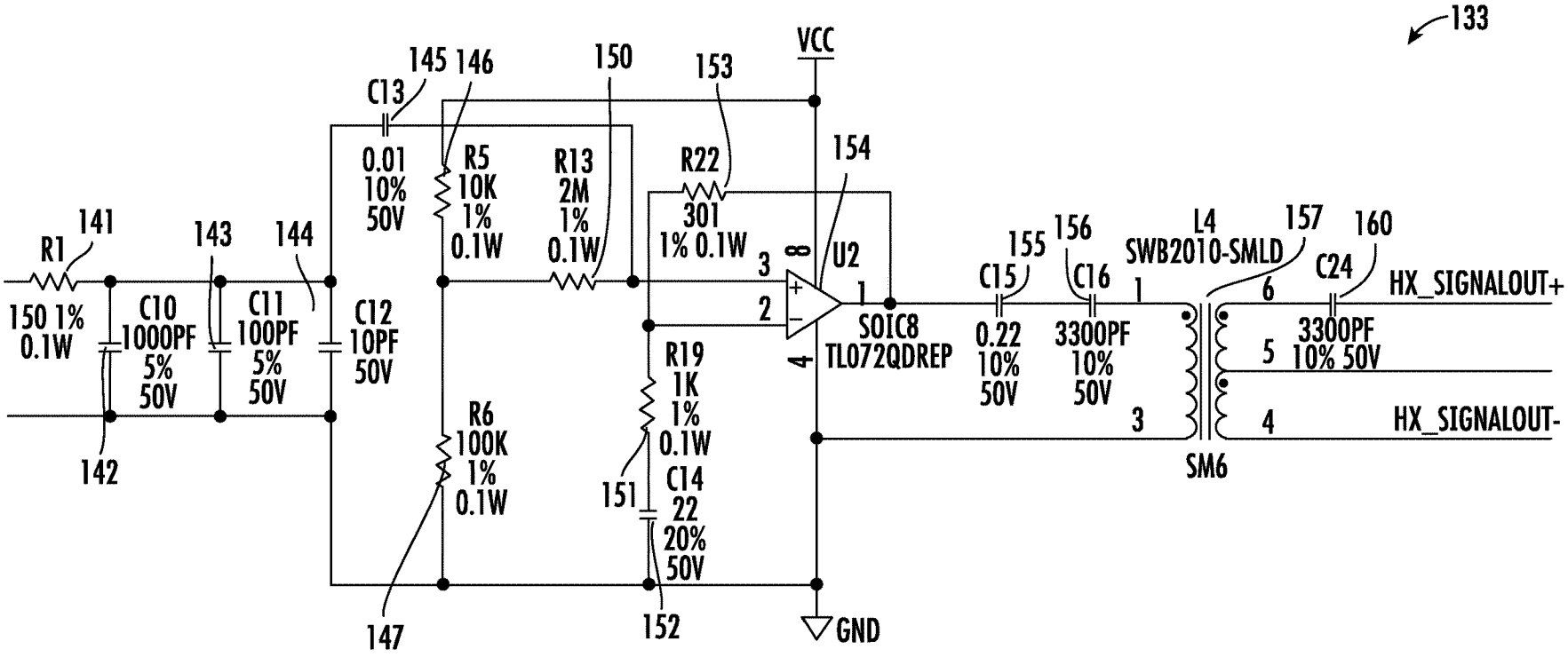
FIG. 7 is a circuit diagram of an amplifier of the eLORAN receiver of FIG. 3.

Referring now to FIG. 7, an example amplifier 133 embodiment of the plurality of amplifiers 133*b*-133*c* (H-field) is shown. This amplifier 133 illustratively includes a first resistor 141, a first capacitor 142 coupled in parallel to the first resistor, a second capacitor 143 coupled in parallel to the first resistor, and a third capacitor 144 coupled in parallel to the first resistor. The amplifier 133 also includes a fourth capacitor 145 coupled in series to the third capacitor 144, a second resistor 146 coupled downstream from the fourth capacitor, a third resistor 147 coupled to the second resistor, and a fourth resistor 150 coupled between the second resistor and the third resistor.

The amplifier 133 illustratively comprises an amplifier circuit 154 having an inverting input, a non-inverting input coupled to the fourth resistor 150, and an output. The amplifier 133 comprises a fifth resistor 151, and a fifth capacitor 152 coupled between the inverting input of the amplifier circuit 154 and a reference voltage (e.g. ground potential). The amplifier 133 comprises a sixth resistor 153 coupled between the output and the inverting input of the amplifier circuit 154. The sixth resistor 153 and the fifth resistor 151 cooperate to adjust the gain level of the amplifier circuit 154. Gain in decibels=10 LOG $(1+R_{153}/R_{151})$, where $R_{153}$ is the resistance of the feedback providing sixth resistor 153 in ohms, and $R_{151}$ is the resistance of the ground providing sixth resistor 153 in ohms. Gain values of 10 to 20 dB have sufficed in prototypes. Adequate received energy is there from the antennas such that the amplification needed is modest, the amplifier 133 most importantly serves an impedance matching function.

The amplifier 133 illustratively comprises a sixth capacitor 155, and a seventh capacitor 156 coupled in series to the output of the amplifier circuit 154. The amplifier 133 includes an output transformer/balun 157 coupled to the seventh capacitor 156, and an eighth capacitor 160 coupled to the output transformer/balun 157.

The amplifier 133*a* serving the E-antenna may constitute a differential amplifier having two active amplifier elements. As can be appreciated, a differential amplifier rejects common mode signals and noise such as be riding on grounds.

Figure 8:
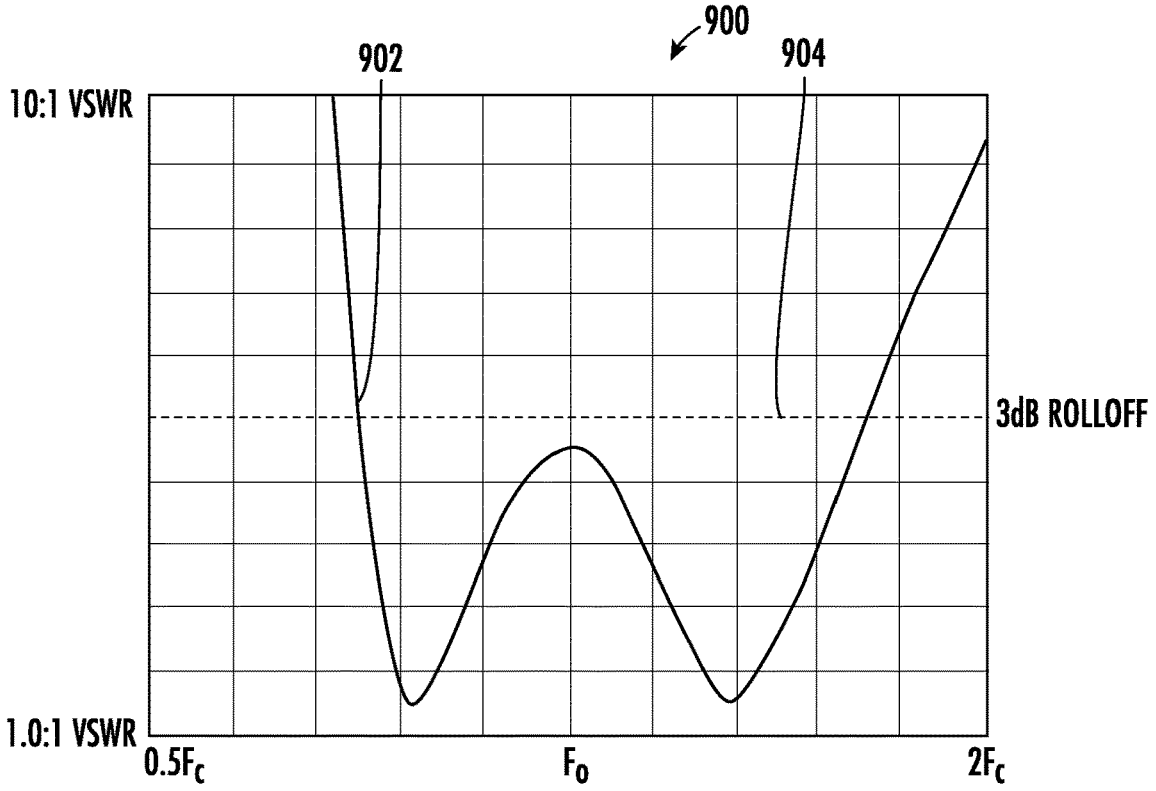
FIG. 8 is a diagram of frequency response of the antenna of FIG. 4.

Referring now additionally to FIG. 8, a diagram 900 depicts the measured voltage standing wave ratio (VSWR) versus frequency response of the antenna 116 with the illustrated two antenna tuning devices 122*a*-122*b* (i.e. a double tuned H-field antenna circuit). Also, the antenna 116 may operate in a parallel resonance mode. Advantageously, the antenna 116 provides a broadband Chebyshev frequency response with a passband ripple peak 902. The antenna 116 bandwidth may be traded for the passband ripple 902 level in FIG. 8, for example, providing a 3 dB gain bandwidth of 80 percent in this instance. In diagram 900 of FIG. 8, the 6 to 1 VSWR frequencies correspond to the 3 dB down frequencies in the antennas gain response as denoted by dashed line 904. Other passband shapes may be provided by the antenna 116, such as a Butterworth passband shape by adjustment of winding position and coupling. As background, in typical approaches, antennas may provide quadratic frequency responses with a single VSWR dip and single gain peak.

Each separately resonated tuning winding 123*a*-123*b* adds another frequency band and provides an extended bandwidth single receive band with a controlled amplitude ripple. As illustrated, the frequency response includes two dips in the passband, which is in contrast to typical approaches that have one dip and narrower bandwidth.

There are several advantages to the three different receive channels provided by the antenna 116: the E-field antenna, the Hx field antenna and the Hy field antenna. The two H-field antenna types are decoupled from one another and orthogonal in orientation, which creates separate sine and cosine radiation patterns in azimuth. The amplitude and phase information from each indicates angle of arrival of the eLORAN signals, which can be beneficial to detect and processing out of reradiation effects from any nearby structures. Also, knowing the direction of arrival eLORAN signal path correction signals may be processed for propagation delay changes at the azimuth involved. The amplitude and phase difference between the E-field and H-field antennas can eliminate angle of arrival ambiguities as for instance 1-cos theta and 1-sin theta patterns may be synthesized. On an aircraft platform, the H-field antennas may be operable when the E-field type antenna is inoperable due to precipitation static, aircraft charging, and proximity to thunderstorms. Thus, an antenna 116 of comprised several antennas provides numerous system advantages.

Yet another aspect is directed to a method of making an antenna 116 to be coupled to eLORAN receiver circuitry 117. The method comprises coupling an H-field signal winding 121*a*-121*b* to a ferromagnetic core 120, and coupling an antenna tuning device 122*a*-122*b* to the ferromagnetic core. The antenna tuning device 122*a*-122*b* comprises at least one tuning winding 123*a*-123*b* surrounding the ferromagnetic core 120, and a tuning circuit 124*a*-124*b* coupled to the at least one tuning winding.

Figure 9:
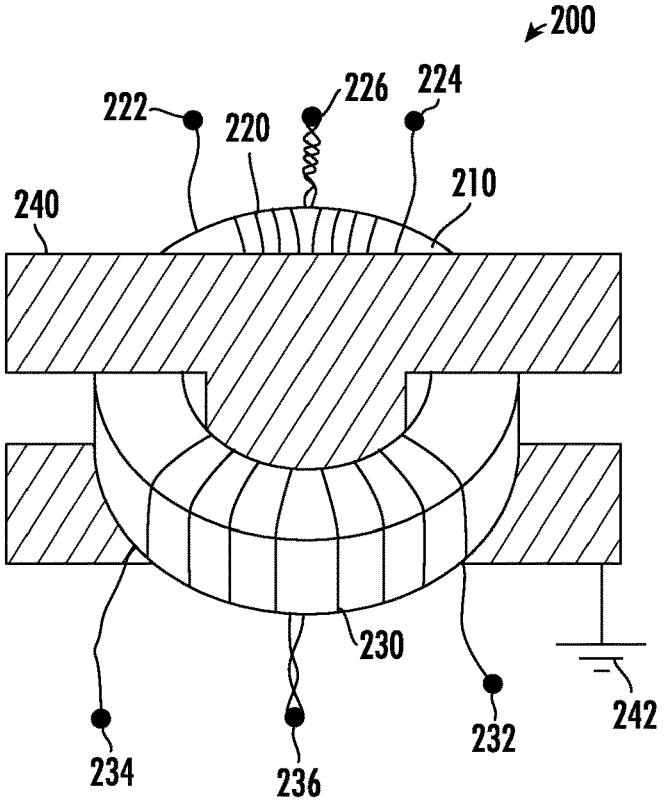
FIG. 9 is a schematic diagram of a balun transformer for the amplifier output of the eLORAN receiver of FIG. 3.

Now turning to FIG. 9, a balun transformer 200 that may accompany the antenna 116 will be now be described. The balun transformer 200 may prevent the conveyance of conducted common mode electromagnetic interference currents into the antenna 116 circuits. Such interference currents may, for instance, ride on the RF cabling between the antenna 116 and the associated eLORAN receiver due to vehicle alternators, digital electronics, or switching power supplies sharing a ground with the eLORAN receiver. The balun transformer 200 may serve as the output transformer/balun 157 of FIG. 7.

The balun transformer 200 illustratively includes a magnetic core 210, such as ferrite or a powdered iron. In the illustrated example, the magnetic core 210 is a toroid, which usefully provides a magnetic circuit to couple a primary winding 220 with a secondary winding 230. The primary winding 220 provides terminals 222, 224 and a center tap terminal 226. The secondary winding 230 provides terminals 232, 234 and a center tap terminal 236. The balun transformer 200 illustratively includes an I-shaped metallic shield 240, such as an I-shaped sheet metal plate, which is present between the primary winding 220 and the secondary winding 230. A ground connection 242 provides conductive electrical contact between the metallic shield 240 and a local ground, such as a PWB ground layer in the antenna preamplifier. The metallic shield 240 reduces the capacitive coupling between the primary winding 220 and secondary winding 230 and in turn reduces the coupling of common mode noise currents that may otherwise be conveyed between the windings of the balun transformer 200.

Other features relating to communication systems are disclosed in co-pending applications: Ser. No. 16/013,106, titled "ELORAN RECEIVER WITH FERROMAGNETIC BODY AND RELATED ANTENNAS AND METHODS," Ser. No. 15/980,857, "TOWER BASED ANTENNA INCLUDING MULTIPLE SETS OF ELONGATE ANTENNA ELEMENTS AND RELATED METHODS," and Ser. No. 16/419,568, "ELORAN RECEIVER AND ANTENNA WITH FERROMAGNETIC BODY AND WINDINGS AND RELATED METHODS," which are incorporated herein by reference in their entirety.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. An enhanced LOng-RAnge Navigation (eLORAN) receiver comprising:
- an antenna and eLORAN receiver circuitry coupled thereto;
- the antenna comprising a ferromagnetic core and an H-field signal winding coupled thereto; and
- an antenna tuning device comprising
  - at least one tuning winding surrounding the ferromagnetic core, and
  - a tuning circuit coupled to the at least one tuning winding.

2. The eLORAN receiver of claim 1 wherein the at least one tuning winding comprises a plurality of tuning windings.

3. The eLORAN receiver of claim 1 wherein the tuning circuit comprises a resistor, and a capacitor coupled in series with the resistor.

4. The eLORAN receiver of claim 1 wherein the antenna comprises a pair of electrostatic patch elements on opposite sides of the ferromagnetic core.

5. The eLORAN receiver of claim 1 wherein the ferromagnetic core comprises a ferromagnetic medial portion and a plurality of ferromagnetic arms extending outwardly therefrom.

6. The eLORAN receiver of claim 5 wherein the plurality of ferromagnetic arms are arranged in aligned pairs.

7. The eLORAN receiver of claim 5 wherein the plurality of ferromagnetic arms defines a cross-shape.

8. The eLORAN receiver of claim 1 wherein the antenna comprises a corrective winding surrounding the ferromagnetic core and configured to receive a calibration signal from the eLORAN receiver circuitry.

9. The eLORAN receiver of claim 1 wherein the ferromagnetic core comprises at least one of ferrite, powdered iron, electrical steel, and nanocrystalline iron.

10. An antenna to be coupled to enhanced LOng-RAnge Navigation (eLORAN) receiver circuitry, the antenna comprising:
- a ferromagnetic core;
- an H-field signal winding coupled to the ferromagnetic core; and
- an antenna tuning device comprising
  - at least one tuning winding surrounding the ferromagnetic core, and
  - a tuning circuit coupled to the at least one tuning winding.

11. The antenna of claim 10 wherein the at least one tuning winding comprises a plurality of tuning windings.

12. The antenna of claim 10 wherein the tuning circuit comprises a resistor, and a capacitor coupled in series with the resistor.

13. The antenna of claim 10 further comprising a pair of electrostatic patch elements on opposite sides of the ferromagnetic core.

14. The antenna of claim 10 wherein the ferromagnetic core comprises a ferromagnetic medial portion and a plurality of ferromagnetic arms extending outwardly therefrom.

15. The antenna of claim 14 wherein the plurality of ferromagnetic arms are arranged in aligned pairs.

16. The antenna of claim 14 wherein the plurality of ferromagnetic arms defines a cross-shape.

17. The antenna of claim 10 further comprising a corrective winding surrounding the ferromagnetic core and configured to receive a calibration signal from the eLORAN receiver circuitry.

18. A method of making an antenna to be coupled to enhanced LOng-RAnge Navigation (eLORAN) receiver circuitry, the method comprising:
- coupling an H-field signal winding to a ferromagnetic core; and
- coupling an antenna tuning device to the ferromagnetic core, the antenna tuning device comprising
  - at least one tuning winding surrounding the ferromagnetic core, and
  - a tuning circuit coupled to the at least one tuning winding.

19. The method of claim 18 wherein the at least one tuning winding comprises a plurality of tuning windings.

20. The method of claim 18 wherein the tuning circuit comprises a resistor, and a capacitor coupled in series with the resistor.

21. The method of claim 18 further comprising positioning a pair of electrostatic patch elements on opposite sides of the ferromagnetic core.

22. The method of claim 18 wherein the ferromagnetic core comprises a ferromagnetic medial portion and a plurality of ferromagnetic arms extending outwardly therefrom.

23. The method of claim 22 wherein the plurality of ferromagnetic arms are arranged in aligned pairs.

24. The method of claim 22 wherein the plurality of ferromagnetic arms defines a cross-shape.

25. The method of claim 18 further comprising coupling a corrective winding to surround the ferromagnetic core and configured to receive a calibration signal from the eLORAN receiver circuitry.

* * * * *